US007083124B2

(12) United States Patent
Bednorz et al.

(10) Patent No.: US 7,083,124 B2
(45) Date of Patent: Aug. 1, 2006

(54) SPRAY GUN

(75) Inventors: Christoph Bednorz, Beckum (DE); Michael Jarchau, Oelde (DE); Manfred Reimann, Schloss Holte-Stukenbrock (DE); Paul Schöning, Beelen (DE)

(73) Assignee: Hammelmann Maschinenfabrik GmbH, Oelde (DE)

( * ) Notice: Subject to any disclaimer, the term of this patent is extended or adjusted under 35 U.S.C. 154(b) by 61 days.

(21) Appl. No.: 10/478,615

(22) PCT Filed: Jul. 11, 2001

(86) PCT No.: PCT/EP02/07337

§ 371 (c)(1),
(2), (4) Date: Nov. 24, 2003

(87) PCT Pub. No.: WO03/006175

PCT Pub. Date: Jan. 23, 2003

(65) Prior Publication Data

US 2004/0167675 A1 Aug. 26, 2004

(30) Foreign Application Priority Data

Jul. 3, 2002 (DE) ..... 101 33 744

(51) Int. Cl.
*B05B 7/02* (2006.01)

(52) U.S. Cl. ..... 239/526; 239/67; 239/69; 239/71; 239/525; 700/283

(58) Field of Classification Search ..... 239/67, 239/69, 525, 526, 71, 74; 700/281, 282, 700/283; 222/146.5; 307/116, 139
See application file for complete search history.

(56) References Cited

U.S. PATENT DOCUMENTS

| | | | | |
|---|---|---|---|---|
| 3,885,739 | A * | 5/1975 | Tuttle | 239/526 |
| 4,162,042 | A * | 7/1979 | Mommsen et al. | 239/526 |
| 4,274,553 | A * | 6/1981 | Evers et al. | 222/146.5 |
| 5,383,605 | A * | 1/1995 | Teague | 239/526 |
| 6,684,133 | B1 * | 1/2004 | Frye-Hammelmann et al. | 700/283 |

FOREIGN PATENT DOCUMENTS

| | | |
|---|---|---|
| DE | 499 704 | 6/1930 |
| DE | DT 2 214 782 | 3/1972 |
| DE | 86 11 018.7 | 4/1986 |
| DE | 196 12 524 A1 | 3/1996 |
| DE | 296 19 975 U1 | 11/1996 |
| DE | 197 38 141 A1 | 9/1997 |
| DE | 198 55 207 C1 | 11/1998 |
| DE | 299 16 710 U1 | 9/1999 |

* cited by examiner

*Primary Examiner*—Steven J. Ganey
(74) *Attorney, Agent, or Firm*—Barnes & Thornburg LLP

(57) ABSTRACT

The invention relates to a spray gun with a handle part (3) comprising a safety switch (6). A nozzle tube (1) is connected on one end of said handle and a feed line (2) is connected to the other end thereof. Said spray gun, which can be actuated in a contactless manner by means of an actuating element (5) and a switch surface (4), is characterised in that the switch surface (4) contains an emitting and receiving unit, whereby the active area thereof is disposed in the antenna field (8) of the switch surface (4) and is connected to an evaluating device (7) which is in permanent active communication with the actuating element (5), which contains an electronic circuit, and which authorises control of the feed supply of the media.

16 Claims, 3 Drawing Sheets

SPRAY GUN

BACKGROUND AND SUMMARY OF THE DISCLOSURE

The present disclosure relates to a spray gun and, more specifically, a spray gun with a safety switch and an on-off switch.

Such spray guns are customarily operated by a liquid medium under high pressure.

Work with spray guns is characterized by high physical stress for the operator as a result of the high holding and recoil forces, the limited view because of fog formation and the humid environment. In addition, a high risk potential is created by the rebounding of material but mainly by the high energy content of the liquid jet, normally a water jet. On the one hand, this requires a construction with a good ergonomic design and the highest safety standard and, on the other hand, that only correspondingly instructed personnel trained for the work with high-pressure water jets are permitted to work with spray guns.

The operation of the spray gun by mechanical or electromechanical operating elements is known.

In this case, an on-and-off switching takes place by a manual lever which is arranged in the handle part and which can be blocked in an inoperative position by a safety switch. For operating the manual lever, a prior releasing of the safety switch from its locking position is therefore required.

However, the function of the manual lever can be achieved only at relatively high constructive expenditures. These expenditures comprise many complicated parts which, on the one hand, require a fairly expensive production and, on the other hand, are relatively susceptible to disturbances. Fragments and residues of the material to be processed by the spray gun may enter into the area of the lever linkage and of the safety device and block the lever linkage and the safety device.

Mechanical lever systems generally require the application of an operating or holding force by the operator. In this case, the operator's hand must necessarily always remain in contact with the lever. During a fairly long switch-on period, this leads to fatigue or even to cramps in the switching hands. As a result, safety-critical situations may arise; for example, because of the fact that the switch-off cannot take place or can only take place in a delayed manner.

It is known from practice that, because of the strained working position, the operating personnel frequently fixes the lever devices by simple means, such as wooden wedges, wire or adhesive tape, against safety regulations, in order to reduce the holding force.

In the case of the construction known from German Patent Document DE 86 11 018 U1, the operation takes place by contactless electronic proximity sensors, for example, according to the inductive principle. The sensor converts a physical quantity to an electric signal and utilizes its change for generating a switching function. Here, the influencing element, which the operator utilizes for the switching, is of a passive nature in that no communication takes place between the operating element and the proximity sensor. This results in the disadvantage of this state of the art that the system can easily be disturbed or even unintentionally switched as a result of outside influences, such as magnetic or electric fields, vibrations or temperatures. Furthermore, safety regulations are easy to bypass by permanently mounting the operating element on the proximity sensor, for example, by adhesive tape or wire. A self-monitoring of the electronic circuit and a checking of the access authorization is not possible or not provided.

Depending on the type of construction, the guidance of the medium is also unsatisfactory in the two constructions. This means that performance-reducing turbulences and frictional losses occur as a result of hydraulic valves and T-shaped or angular connection elements which impair the efficiency of such spray guns.

The handling of these spray guns is also unsatisfactory. Particularly from an ergonomic point of view, their extended use may be detrimental to an operator's health, for example, as a result of muscular tenseness or the like.

The spray gun of the present disclosure has significant advantages in comparison to the state of the art. The contactless actuation of the spray gun without moving parts takes place by an active system which is distinguished by the fact that the actuating element, preferably a transponder, communicates with a reading station of an electronic evaluating device within the spray gun. As a result, it becomes possible to ensure the highest possible safety standard for the operator as well as for persons and objects in his environment.

The transponder is a microelectronic circuit with a transmitting and receiving antenna, a control logic and a fixedly stored safety code as well as an energy accumulator which provides the energy for the return of the safety code. The transponder receives energy packets pulsed at regular intervals from the reading unit of the spray gun and returns information. This takes place by way of antennas in the handle tube which are arranged in pairs in order to generate a concentric field without pole points so that a uniform defined switching interval is ensured.

The transponder has a unique identification number which, when it is entered into the antenna field, is sent to the reading unit by the transponder in order to enable the authorization. This reading unit checks the identification code and makes a decision concerning the enabling. Thus, it is ensured that only authorized persons can start the operation of a spray gun and outside influences cause no safety-relevant malfunctioning.

The transponder is arranged as a separate part, for example, in the user's finger range. Here, it may, for example, be a component of a glove, a finger ring or a finger covering. The switch-off takes place by moving the transponder out of the antenna field.

The protection against an unintentional actuating is ensured by a safety switch without movable parts, preferably a piezo key. When actuated, the latter enables the switch-on function for a certain time, specifically only when previously no transponder has been situated in the antenna field. As a result, a bypassing of the OFF-function by a permanent mounting of the transponder on the handle pipe, for example, by gluing, is prevented. The enabling time window can be adjusted by an external evaluating and programming unit and typically amounts to 1–3 seconds.

By way of the program of the evaluating device, the function of a circuit breaker is also assigned to the safety switch. In addition to moving the transponder out of the antenna field, this provides a second possibility of changing the system to a safe pressureless condition.

The reading and evaluating unit is conceived to be self-monitoring, so that, in the case of defects within the electronic unit, the system itself is automatically always changed to the safe, that is, non-energized condition. This is achieved by a second transponder which is fixedly installed on the printed circuit board together with a reference antenna. Before each enabling, by inactivating the testing transponder, the electronic unit internally examines whether an off-command is taking place. Only when this is properly implemented, will the external switching function be enabled. The signal exchange takes place dynamically by way of radio communications; that is, with an alternating switching of the antennas between the transmitting and receiving mode, so that a defective final stage of the electronic unit immediately results in a switch-off.

Furthermore, the present spray gun offers the possibility of reading out, by way of a connected evaluating and programming unit, operating data which are detected and stored by the electronic evaluating unit of the spray gun, such as switch-on periods with the date and the time, the summed-up operating duration or the like. These data can be used for controlling the working times, as a basis of calculation and planning as well as in the sense of a preventive servicing and maintenance of the pressure-guiding system. This also results in a significant advantage with respect to the state of the art, where this has so far not been possible.

In addition, by way of an external programming, the spray gun offers the possibility of a remote control without accessory parts. For this purpose, an external command is assigned to a certain combination of signals of the safety key and of the transponder. Thus, for example, by actuating the safety key three times within a permissible, also programmable time window, a high-pressure aggregate can be switched on for supplying the spray gun. In this case, the actuation may be indicated by acoustic signals.

The spray gun is conceived to be essentially independent of constructional requirements caused by the function. Thus, for example, the media flow can be optimized; that is, it is to be designed such that turbulences and/or hydraulic resistance are very slight so that the friction losses on the whole are minimized. The efficiency of the spray gun is optimized to a considerable extent.

The new spray gun also offers unlimited possibilities with respect to an ergonomic design freedom.

As a result of the absence of, in particular, movable components, the spray gun can now be produced at a significantly lower price and is not susceptible to interfering influences, such as becoming dirty. Also, parts which are subject to wear are eliminated, so that the service life of the spray gun is increased, in fact, is virtually unlimited, at least with respect to the wear caused by the operation.

The nozzle tube and the feed line are connected with one another in the area of the handle part by an uninterrupted connection tube. They can be bent in one piece from a tube which has a continuously smooth wall on the interior side.

The site of the switching is not defined in a punctiform manner but as a surface. Therefore, the user can grip the spray gun at any point of the switch surface and in the process switch it on and off or leave it in the switched-on condition.

When the nozzle tube is very short, it is possible that the operator's hand may reach the danger range of the water jet. In order to avoid this, according to the disclosure, an additional switch surface can be provided on the handle part, and the operator can be equipped with a second actuating element. Before an enabling, the electronic evaluating unit of the spray gun will then examine whether both hands are within the range of the switch surfaces and thus outside the danger range of the water jet.

Naturally, the spray gun is not limited to a use as a spray gun for liquid media but is definitely also suitable for a use as a compressed-air spray gun.

These and other aspects of the present disclosure will become apparent from the following detailed description of the disclosure, when considered in conjunction with accompanying drawings.

DETAILED DESCRIPTION OF THE DRAWINGS

Figure 1:
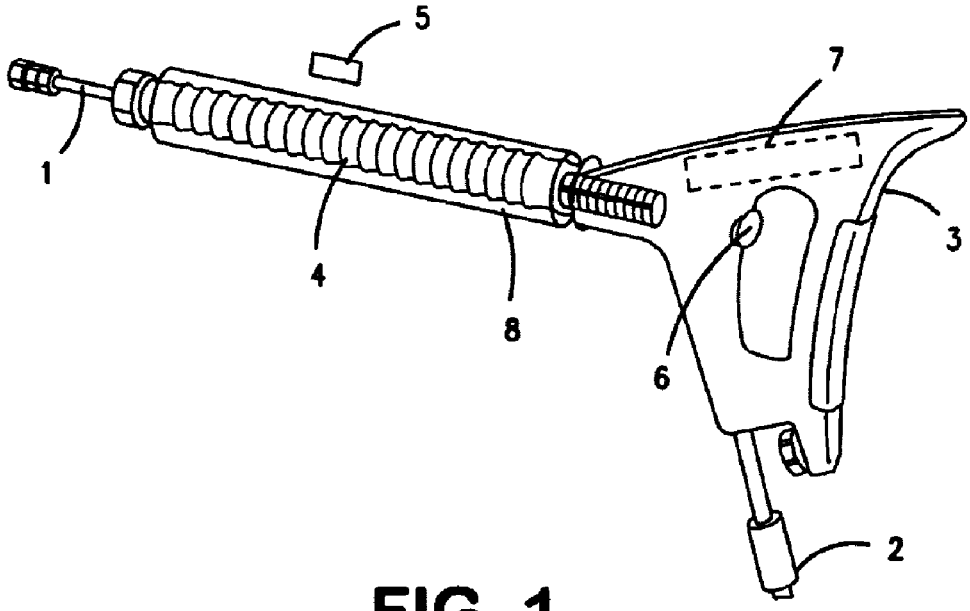
FIGS. 1 and 2 each are perspective views of an embodiment of a spray gun according to the disclosure.

FIG. 1 illustrates a spray gun which has a handle part 3, to whose one end a nozzle tube 1 is connected and to whose other hand a feed line 2 is connected.

Figure 4:
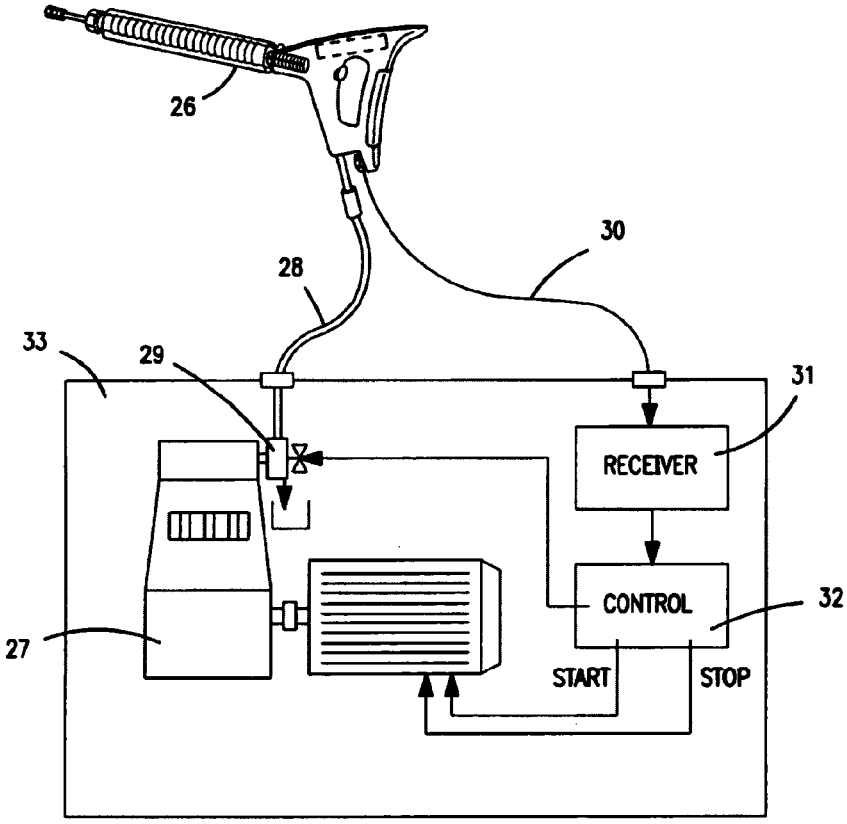
FIG. 4 is a functional diagram of the spray gun connected to a high-pressure aggregate.

The feed line 2 may be connected with a high-pressure aggregate 33 (FIG. 4).

In the illustrated embodiment, a partial area of the handle part 3 is provided with a contactless switch surface 4, specifically in the end area facing the nozzle tube 1.

A safety switch 6 is arranged within the handle part 3, which safety switch 6 is electrically connected with an evaluating device 7 in the same manner as the contactless switch surface 4.

For the operation of the spray gun, the safety switch 6 has to be actuated first, specifically by being touched. Subsequently, for example, within 1 to 2 seconds, the contactless switch surface 4 has to be gripped by the user on whose hand a contactless actuating element 5 is mounted which includes a safety code. The switching operation is triggered when the actuating element 5 enters an antenna field 8 of the switch surface 4 or leaves it again.

After each switch-off by way of the switch surfaces 4 and the actuating element 5, the safety switch 6 has to be newly activated. As a result, a safety level is reached which is significantly higher than that of conventional mechanical safety switches.

This switch-on operation is detected by the evaluating unit 7 and is transmitted to a control by which the high-pressure aggregate or an integrated bypass valve is opened, so that a medium can flow by way of the feed line 2 into the nozzle tube 1.

The evaluating unit 7 can additionally be used for the data acquisition and can be connected to a computer in which the operating data are evaluated.

The contactless switch surface 4 with the antenna field 8 preferably extends over the complete circumference of the respective area, whereby the gripping surface is freely selectable. That is, the user can grip the contactless switch surface 4 for triggering at any point. Expediently, the contactless switch surface 4 and the contactless actuating element 5 are configured such that no touching of both components is required. On the contrary, the switching function occurs already when the contactless actuating element 5 is placed approximately in an area of up to 30 mm from the contactless switch surfaces 4, which corresponds to the radial dimension of the antenna field 8. This permits an encompassing grip during the operation, during which, after all, the grip has to be loosened, without immediately switching off the supply of the high-pressure water.

Figure 2:
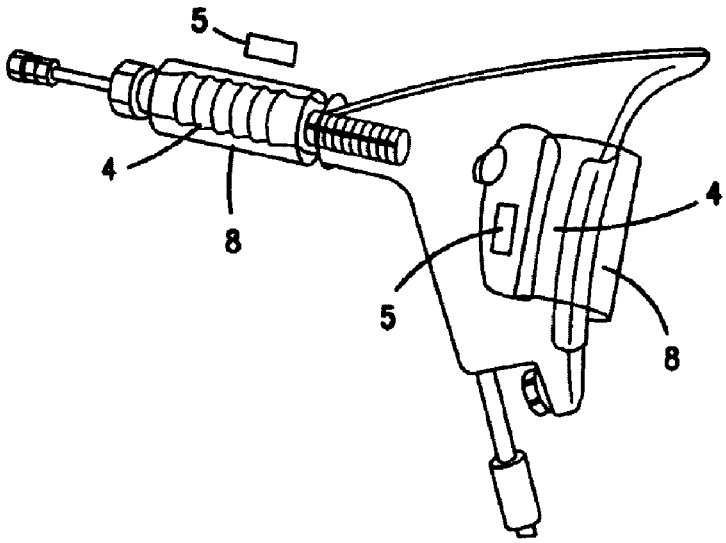

FIG. 2 is a perspective view of a spray gun with the arrangement of the actuating elements 5 for a two-hand operation. Constructively, two switch surfaces 4 with the respective antenna fields 8 as well as two actuating elements 5 are provided. In this case, the evaluating unit 7 is programmed such that a switching-on can only take place when both actuating elements 5 are in the area of the switch surfaces 4.

Figure 3:
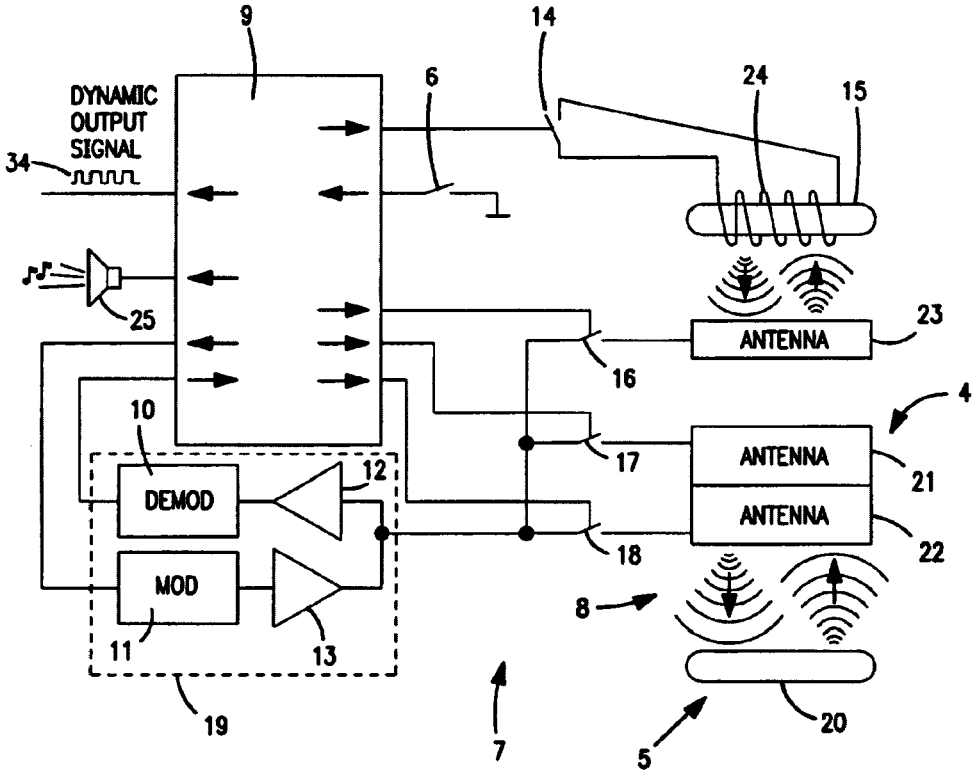
FIG. 3 is a block diagram relating to the signal flow within the spray gun.

FIG. 3 is a block diagram relating to the signal flow within the spray gun and the method of operation of the evaluating unit 7.

The evaluating unit 7 consists of the following components:

Microcontroller 9 which carries out the controlling of the operating sequence as well as the antenna changeovers, the system checks and the dynamic output signal conditioning;

demodulator 10 for the high-frequency signal demodulation;

modulator 11 for the high-frequency signal modulation;

input amplifier 12 for amplifying the antenna signals;

output amplifier 13 for the operation as a transmitting antenna;

switch 14 for activating the shield winding of a reference transponder 15;

switch 16, 17, 18 for connecting different antennas to a transceiver 19;

reference transponder 15 which is situated in the interior of the spray gun and by which the reliability of the system is checked;

working transponder 20 which is moved by the operator from the outside into the antenna field 8;

antenna 21 and antenna 22, which are both offset by 90° and are activated in an alternating manner in order to eliminate the pole points of the antennas;

reference antenna 23 which is situated in the interior of the spray gun and by which the reliability of the system is checked;

shield winding 24 by which the reference transponder 15 can be shielded electronically so that it can be checked whether the transceiver 19 is operating correctly;

safety switch 6 which, after being actuated, initiates the enabling time in which the antenna for the working transponder 20 is cleared;

piezo buzzer 25 which acoustically indicates the enabling time and generates different sounds for facilitating the operation.

After the operating voltage is switched on, the high-pressure signal 34 is first switched to the "OFF" position, and subsequently a self-control of the system is carried out. Working and programming memories are checked, and by the following sequence, the transceiver 19 is checked for its correct functioning: 1. The microcontroller 9 closes the switch 16 and opens all other switches. It thereby connects the internal reference antenna 23 to the transceiver 19. Now, the reference transponder 15, which is mounted in the direct proximity of the reference antenna 23, is activated and read.

The result has to be identical with the reference code stored in the microcontroller. When the comparison is positive, Step 2 is now initiated. If not, the microcontroller 9 terminates the check and emits an error code which resets the entire system.

2. The microcontroller 9 now closes switch 14 and switch 16. As a result, the reference antenna 23 is again connected to the transceiver 19. In addition, the shield winding 24 is short-circuited which envelopes the reference transponders 15 in a Faraday cage. As a result, the electric field of the reference antenna 23 is kept away from the reference transponder 15, so that the reference antenna 23 can receive no signal. As a result, the transponder 20 is taken out of the antenna field 8 and not stimulated. Now, no signal must be received. Then it is also ensured that the entire chain consisting of the input amplifier 12, the output amplifier 13, the modulator 11 and the demodulator 10, thus the entire transceiver 19, is operating correctly. The transceiver check was concluded successfully.

However, if now the signal of the reference transponder 15 were to be received, the microcontroller 9 would terminate the check and emit an error code which then resets the entire system.

This transceiver check is carried out continuously as long as the safety switch 6 is not actuated. When the safety switch 6 is pressed, the system first switches to the antenna 21, then to the antenna 22 and checks whether a transponder 20 is situated in the antenna field 8. Only when no transponder 20 is situated in the antenna field 8, will the enabling time be started and be acoustically indicated by an interval sound from buzzer 25. Now, the microcontroller 9 will always alternately scan the two antennas 21 and 22 for the duration of the enabling time.

If a transponder 20 is detected in the antenna field 8 within the enabling time, the high pressure is switched on by a dynamic coded signal 34. The switch-off takes place either by actuating the safety switch 6 or by removing the working transponder 20 from the antenna field 8.

FIG. 4 shows the functional diagram of the spray gun 26 in connection with the high-pressure aggregate 33. The high-pressure aggregate 33 consists of the pump unit with the driving motor 27, a bypass valve 29 fastened on the output side of the pump, a receiver 31 and the control 32.

The high-pressure aggregate 33 is connected with the spray gun 26 by way of the high-pressure line 28 which ensures the feeding of the high-pressure water, and the control line 30. By way of the control line 30, the signals 34 of the spray gun are guided to the receiver 31 for the evaluation and from there, to the control 32 which transmits the commands for the switch-on and switch-off of the high-pressure water to the bypass valve 29 or, for the start and stop of the aggregate, to the pump unit with the driving motor 27.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding based on communication with the actuating device.

2. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein the actuating device includes a safety code transmitted to the evaluating device.

3. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein the actuating device is a transponder.

4. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein, when actuated, the safety switch enables a switch-on function within a time window.

5. The spray gun according to claim 4, wherein a switch-off and remote control functions are implemented by the safety switch.

6. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein operating data is detected and stored by the evaluating device, which operating data can be read and processed by programming and evaluating units.

7. The spray gun according to claim 5, wherein functions for remote control and for time-related control can be inputted into the evaluating device by programming and evaluating units.

8. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein the evaluating device has a circuit for self-monitoring.

9. The spray gun according to claim 1, wherein the nozzle tube and the feed line consist, without interruption, of one piece in the area of the handle part.

10. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein a concentric pole-point-free antenna field can be generated in the switch surface by at least two antennas, which are controlled in an alternating manner by the evaluating device.

11. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein two switch surfaces are present which, for the actuation, both must be brought into an operating connection with corresponding actuating devices.

12. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein a switch-off and remote control functions are implemented by the safety switch.

13. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein functions for remote control and for time-related control are inputted into the evaluating device by programming and evaluating units.

14. The spray gun according to claim 8, wherein the self-monitoring circuit includes a reference antenna and a reference actuating device which are selectively operated by the evaluating device.

15. The spray gun according to claim 8, wherein the self-monitoring circuit is activated only when the safety switch is not actuated.

16. A spray gun comprising:

a handle part having one end connected to a nozzle tube and another end connected to a feed line;

a safety switch on the handle part;

an antenna on the handle part and having an antenna field adjacent a switch surface of the handle part;

a transceiver connected to the antenna; and an evaluating device on the handle part and connected to the safety switch and the transceiver and to media feeding control, the evaluating device actively communicating with an actuating device which contains an electronic circuit and is in the antenna field, and the evaluating device makes a decision on media feeding; and wherein the evaluating unit activates the media feeding only if the actuating device is not in the antenna field at the actuation of the safety switch and is in the antenna field in a subsequent enabling period after actuation of the safety switch.

* * * * *